US011253741B2

(12) United States Patent
Leipheimer

(10) Patent No.: US 11,253,741 B2
(45) Date of Patent: Feb. 22, 2022

(54) CAM MECHANISM FOR ADJUSTABLE TORQUE WITHOUT CABLE SLACK

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 275 days.

(21) Appl. No.: 16/487,215

(22) PCT Filed: Mar. 7, 2018

(86) PCT No.: PCT/US2018/021246
§ 371 (c)(1),
(2) Date: Aug. 20, 2019

(87) PCT Pub. No.: WO2018/165226
PCT Pub. Date: Sep. 13, 2018

(65) Prior Publication Data

US 2021/0283454 A1 Sep. 16, 2021

Related U.S. Application Data

(60) Provisional application No. 62/468,123, filed on Mar. 7, 2017.

(51) Int. Cl.

| | |
|---|---|
| ***A63B 21/00*** | (2006.01) |
| *A63B 21/062* | (2006.01) |
| *A63B 23/04* | (2006.01) |

(52) U.S. Cl.
CPC ..... *A63B 21/155* (2013.01); *A63B 21/00072* (2013.01); *A63B 21/0628* (2015.10); *A63B 23/0494* (2013.01)

(58) Field of Classification Search
CPC ..... A63B 21/00072; A63B 21/0628; A63B 21/155; A63B 21/00058; A63B 21/062;
(Continued)

(56) References Cited

U.S. PATENT DOCUMENTS

| | | | |
|---|---|---|---|
| 4,982,956 | A | 1/1991 | Lapcevic |
| 5,088,726 | A | 2/1992 | Lapcevic |

(Continued)

FOREIGN PATENT DOCUMENTS

| | | | |
|---|---|---|---|
| EP | 0857496 | A2 | 8/1998 |
| JP | 4126567 | U | 11/1992 |

(Continued)

*Primary Examiner* — Megan Anderson
(74) *Attorney, Agent, or Firm* — The Webb Law Firm

(57) ABSTRACT

A cam mechanism may include a cam assembly rotatably mounted to an axis shaft and having a profile arc adapted for receiving a belt or cable, a belt adjustment lever pivotally mounted to the cam assembly and having a control bearing, and a cam range slot plate rigidly mounted to the axis shaft and defining a slot in sliding communication with the control bearing of the belt adjustment lever, wherein the belt adjustment lever is connected to one end of a belt or cable, and the opposite end of the belt or cable is connected to a moveable weight stack, and wherein the cam assembly is rotatable relative to the cam range slot plate.

20 Claims, 10 Drawing Sheets

(58) Field of Classification Search
CPC ..... A63B 21/0622; A63B 21/0624; A63B 21/0626; A63B 21/063; A63B 21/0632; A63B 23/0494
See application file for complete search history.

(56) References Cited

U.S. PATENT DOCUMENTS

| | | | | |
|---|---|---|---|---|
| 5,102,121 | A | 4/1992 | Solow et al. | |
| 5,356,360 | A | 10/1994 | Johns | |
| 5,580,341 | A | 12/1996 | Simonson | |
| 5,624,353 | A * | 4/1997 | Naidus | A63B 21/0616 482/137 |
| 5,643,152 | A | 7/1997 | Simonson | |
| 5,722,921 | A | 3/1998 | Simonson | |
| 7,282,015 | B1 | 10/2007 | White | |
| 10,052,515 | B2 * | 8/2018 | Leipheimer | F16H 25/18 |
| 2003/0092540 | A1 | 5/2003 | Gillen | |
| 2008/0058177 | A1 | 3/2008 | Webber et al. | |
| 2008/0167169 | A1 | 7/2008 | Giannelli | |
| 2008/0312039 | A1 | 12/2008 | Bucay-Bissu et al. | |
| 2010/0120590 | A1 | 5/2010 | Inaizumi | |
| 2010/0152001 | A1 | 6/2010 | Gordon | |
| 2010/0204021 | A1 | 8/2010 | Giannelli | |
| 2011/0034304 | A1 | 2/2011 | Kuo | |
| 2016/0346585 | A1 | 12/2016 | Habing | |

FOREIGN PATENT DOCUMENTS

| | | | |
|---|---|---|---|
| JP | 200737980 | A | 2/2007 |
| KR | 101637146 | | 7/2016 |
| WO | 2015148925 | A1 | 10/2015 |

* cited by examiner

CAM MECHANISM FOR ADJUSTABLE TORQUE WITHOUT CABLE SLACK

CROSS-REFERENCE TO RELATED APPLICATIONS

This application is the United States national phase of International Application No. PCT/US2018/021246 filed Mar. 7, 2018, and claims the benefit of U.S. Provisional Patent Application No. 62/468,123 filed Mar. 7, 2017, the disclosures of which are hereby incorporated by reference in their entirety.

BACKGROUND OF THE INVENTION

Field of the Invention

The present invention relates generally to cams. Particularly, the invention relates to adjustable cams designed for exercise equipment.

Description of Related Art

In this country there is a concern about the growing obesity rate and counteracting an increasingly sedentary lifestyle. More people are going to the gym and finding exercise machines a safer alternative to free weights. Exercise machines are becoming more sophisticated, and gyms are buying more machines to focus on different muscle groups. Many exercise machines employ a cable or belt system routed around various pulleys to transmit force exerted by a user to a moveable weight stack. Some of these exercise machines also provide a variable-radius cam to which a cable or belt is secured and routed around. The variable radius of such a cam alters the mechanical advantage applied against the weight stack throughout the range of motion of an exercise movement.

U.S. Pat. No. 4,982,956 to Lapcevic discloses adjusting the strength curve by rotating the cam about the machine shaft. Lapcevic also discloses that a supplemental cable-receiving mechanism is needed to keep the cable taut.

U.S. Patent Publication No. 2003/0092540 to Gillen discloses a range-limiting device that uses multiple cam followers and a defined track on the exercise frame to adjust the cam. Gillen also discloses tracking the belt to keep the belt tight.

U.S. Pat. No. 5,722,921 to Simonson discloses a range-limiting device like Gillen, where the exercise input arm is attached to the cam and works with the cam to change the strength curve. Like Lapcevic, Simonson needs a supplemental cable or belt-receiving mechanism to keep the belt tight.

U.S. Pat. No. 5,356,360 to Johns is similar to Simonson but does not use a track mechanism attached to the frame to resist backward movement of the cam and to control cable slack. Rather, Johns uses a linkage to control cable slack. Further, like the other prior art, Johns discloses rotating the cam around the input shaft to achieve the strength curve.

U.S. Pat. No. 5,102,121 to Solow discloses using a supplemental cable-receiving device where the cam profile rotates around the main axis for strength curve.

Adjustment of the exercise cams of the prior art may result in loosening of the cable or belt, since the belt length from the cam attachment point to the weight stack will vary as the eccentric profile of the cam is rotated.

SUMMARY OF THE INVENTION

In view of the foregoing, the need exists for an exercise machine wherein an adjustment of the cam mechanism does not affect the tautness of the cable of belt.

In one aspect of the present disclosure, a cam mechanism may include a cam assembly rotatably mounted to an axis shaft and having a profile arc adapted for receiving a belt or cable, a belt adjustment lever pivotally mounted to the cam assembly and having a control bearing, and a cam range slot plate rigidly mounted to the axis shaft and defining a slot in sliding communication with the control bearing of the belt adjustment lever, wherein the belt adjustment lever is connected to one end of a belt or cable, and the opposite end of the belt or cable is connected to a moveable weight stack, and wherein the cam assembly is rotatable relative to the cam range slot plate.

In one aspect of the present disclosure, the cam assembly may be lockable in a plurality of predetermined positions relative to the cam range slot plate. Rotation of the cam assembly relative to the cam range slot plate may cause the control bearing of the belt adjustment lever to slide within the slot of the cam range slot plate. A pivot axis of the belt adjustment lever may be substantially parallel to a pivot axis of the cam assembly. An input range plate may be positioned on the axis shaft. The input range plate may facilitate rotational movement between the cam mechanism and an exercise arm attached to the cam mechanism. The slot defined in the cam range slot plate may be eccentric. As the cam assembly is rotated and the control bearing slides along the slot, a belt attachment point of the belt adjustment lever may maintain a same overall distance from a movable weight stack. The slot may fully-constrain the control bearing therein.

In one aspect of the present disclosure, an exercise machine may include a movable weight stack, an exercise arm connected to the movable weight stack via a belt or cable, wherein the exercise arm is rotatable about an axis shaft, and a cam mechanism positioned on the axis shaft, the cam mechanism may include a cam assembly rotatably mounted to an axis shaft and having a profile arc adapted for receiving a belt or cable, a belt adjustment lever pivotally mounted to the cam assembly and having a control bearing, and a cam range slot plate rigidly mounted to the axis shaft and defining a slot in sliding communication with the control bearing of the belt adjustment lever, wherein the belt adjustment lever is connected to one end of a belt or cable, and the opposite end of the belt or cable is connected to a moveable weight stack, and wherein the cam assembly is rotatable relative to the cam range slot plate.

In one aspect of the present disclosure, the cam assembly may be lockable in a plurality of predetermined positions relative to the cam range slot plate. Rotation of the cam assembly relative to the cam range slot plate may cause the control bearing of the belt adjustment lever to slide within the slot of the cam range slot plate. A pivot axis of the belt adjustment lever may be substantially parallel to a pivot axis of the cam assembly. An input range plate may be positioned on the axis shaft. The input range plate may facilitate rotational movement between the cam mechanism and an exercise arm attached to the cam mechanism. The slot defined in the cam range slot plate may be eccentric. As the cam assembly is rotated and the control bearing slides along the slot, a belt attachment point of the belt adjustment lever may maintain a same overall distance from a movable weight stack. The slot may fully-constrain the control bearing therein.

In one aspect of the present disclosure, a method of adjusting a cam mechanism on an exercise machine may include rotating a cam assembly relative to a cam range slot plate, moving a control bearing of a belt adjustment lever within a slot defined in the cam range slot plate to maintain a distance between a belt attachment point of the belt adjustment lever relative to a movable weight stack, and locking the cam assembly to prevent rotation of the cam assembly relative to the cam range slot plate. The slot may be eccentric.

Further aspects of the invention are recited in the following clauses:

Clause 1: A cam mechanism comprising: a cam assembly rotatably mounted to an axis shaft and having a profile arc adapted for receiving a belt or cable; a belt adjustment lever pivotally mounted to the cam assembly and having a control bearing; and a cam range slot plate rigidly mounted to the axis shaft and defining a slot in sliding communication with the control bearing of the belt adjustment lever; wherein the belt adjustment lever is connected to one end of a belt or cable, and the opposite end of the belt or cable is connected to a moveable weight stack; wherein the cam assembly is rotatable relative to the cam range slot plate.

Clause 2: The cam mechanism as recited in Clause 1, wherein the cam assembly is lockable in a plurality of predetermined positions relative to the cam range slot plate.

Clause 3: The cam mechanism as recited in Clause 1 or 2, wherein rotation of the cam assembly relative to the cam range slot plate causes the control bearing of the belt adjustment lever to slide within the slot of the cam range slot plate.

Clause 4: The cam mechanism as recited in any of Clauses 1-3, wherein a pivot axis of the belt adjustment lever is substantially parallel to a pivot axis of the cam assembly.

Clause 5: The cam mechanism as recited in any of Clauses 1-4, further comprising an input range plate positioned on the axis shaft.

Clause 6: The cam mechanism as recited in Clause 5, wherein the input range plate facilities rotational movement between the cam mechanism and an exercise arm attached to the cam mechanism.

Clause 7: The cam mechanism as recited in any of Clauses 1-6, wherein the slot defined in the cam range slot plate is eccentric.

Clause 8: The cam mechanism as recited in any of Clauses 1-7, wherein, as the cam assembly is rotated and the control bearing slides along the slot, a belt attachment point of the belt adjustment lever maintains a same overall distance from a movable weight stack.

Clause 9: The cam mechanism as recited in any of Clauses 1-8, wherein the slot fully-constrains the control bearing therein.

Clause 10: An exercise machine, comprising: a movable weight stack; an exercise arm connected to the movable weight stack via a belt or cable, wherein the exercise arm is rotatable about an axis shaft; and a cam mechanism positioned on the axis shaft, the cam mechanism comprising: a cam assembly rotatably mounted to an axis shaft and having a profile arc adapted for receiving a belt or cable; a belt adjustment lever pivotally mounted to the cam assembly and having a control bearing; and a cam range slot plate rigidly mounted to the axis shaft and defining a slot in sliding communication with the control bearing of the belt adjustment lever; wherein the belt adjustment lever is connected to one end of a belt or cable, and the opposite end of the belt or cable is connected to a moveable weight stack; and wherein the cam assembly is rotatable relative to the cam range slot plate.

Clause 11: The exercise machine as recited in Clause 10, wherein the cam assembly is lockable in a plurality of predetermined positions relative to the cam range slot plate.

Clause 12: The exercise machine as recited in Clause 10 or 11, wherein rotation of the cam assembly relative to the cam range slot plate causes the control bearing of the belt adjustment lever to slide within the slot of the cam range slot plate.

Clause 13: The exercise machine as recited in any of Clauses 10-12, wherein a pivot axis of the belt adjustment lever is substantially parallel to a pivot axis of the cam assembly.

Clause 14: The exercise machine as recited in any of Clauses 10-13, further comprising an input range plate positioned on the axis shaft.

Clause 15: The exercise machine as recited in Clause 14, wherein the input range plate facilities rotational movement between the cam mechanism and an exercise arm attached to the cam mechanism.

Clause 16: The exercise machine as recited in any of Clauses 10-15, wherein the slot defined in the cam range slot plate is eccentric.

Clause 17: The exercise machine as recited in any of Clauses 10-16, wherein, as the cam assembly is rotated and the control bearing slides along the slot, a belt attachment point of the belt adjustment lever maintains a same overall distance from a movable weight stack.

Clause 18: The exercise machine as recited in any of Clauses 10-17, wherein the slot fully-constrains the control bearing therein.

Clause 19: A method of adjusting a cam mechanism on an exercise machine, comprising: rotating a cam assembly relative to a cam range slot plate; moving a control bearing of a belt adjustment lever within a slot defined in the cam range slot plate to maintain a distance between a belt attachment point of the belt adjustment lever relative to a movable weight stack; and locking the cam assembly to prevent rotation of the cam assembly relative to the cam range slot plate.

Clause 20: The method as recited in Clause 19, wherein the slot is eccentric.

These and other features and characteristics of the cam mechanism, as well as the methods of operation and functions of the related elements of the cam mechanism, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

DESCRIPTION OF THE INVENTION

Figure 1:
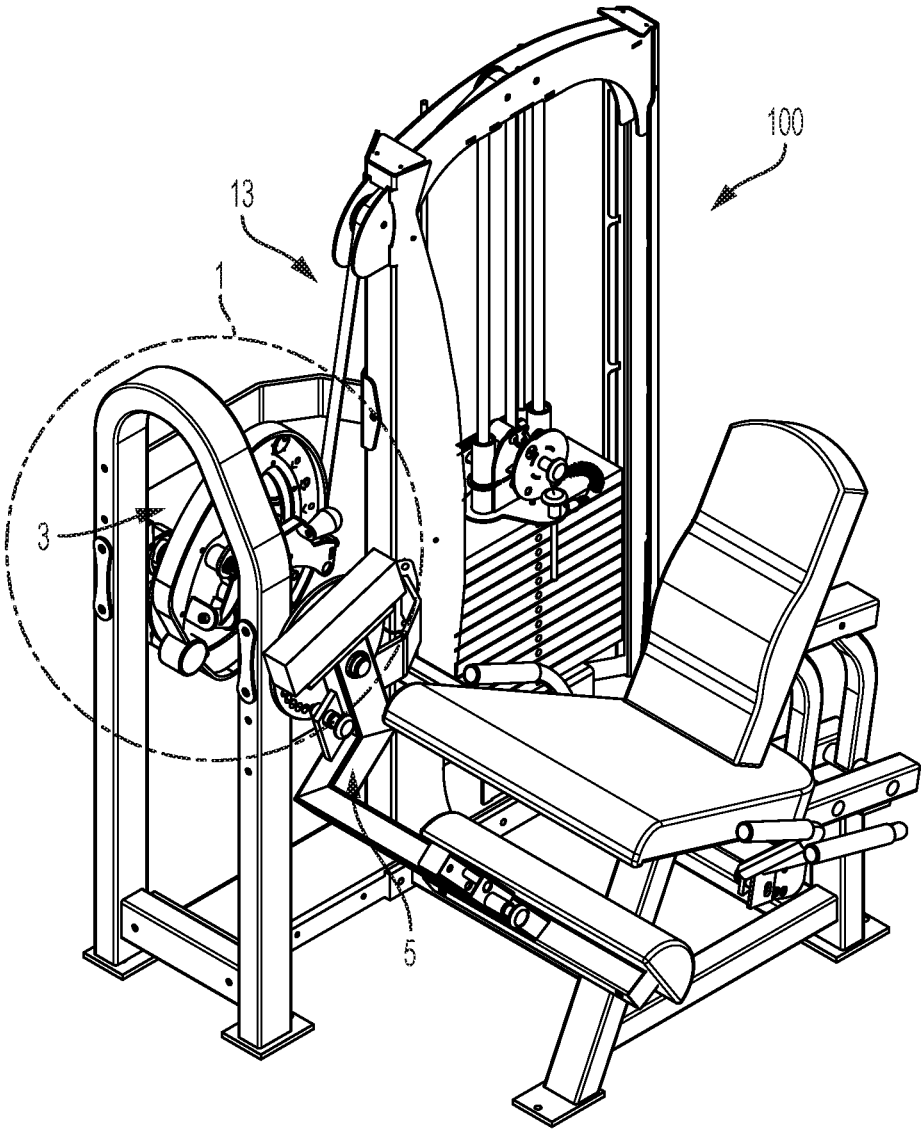
FIG. 1 is a perspective view of an exercise machine including a cam assembly of the present invention.
Figure 2:
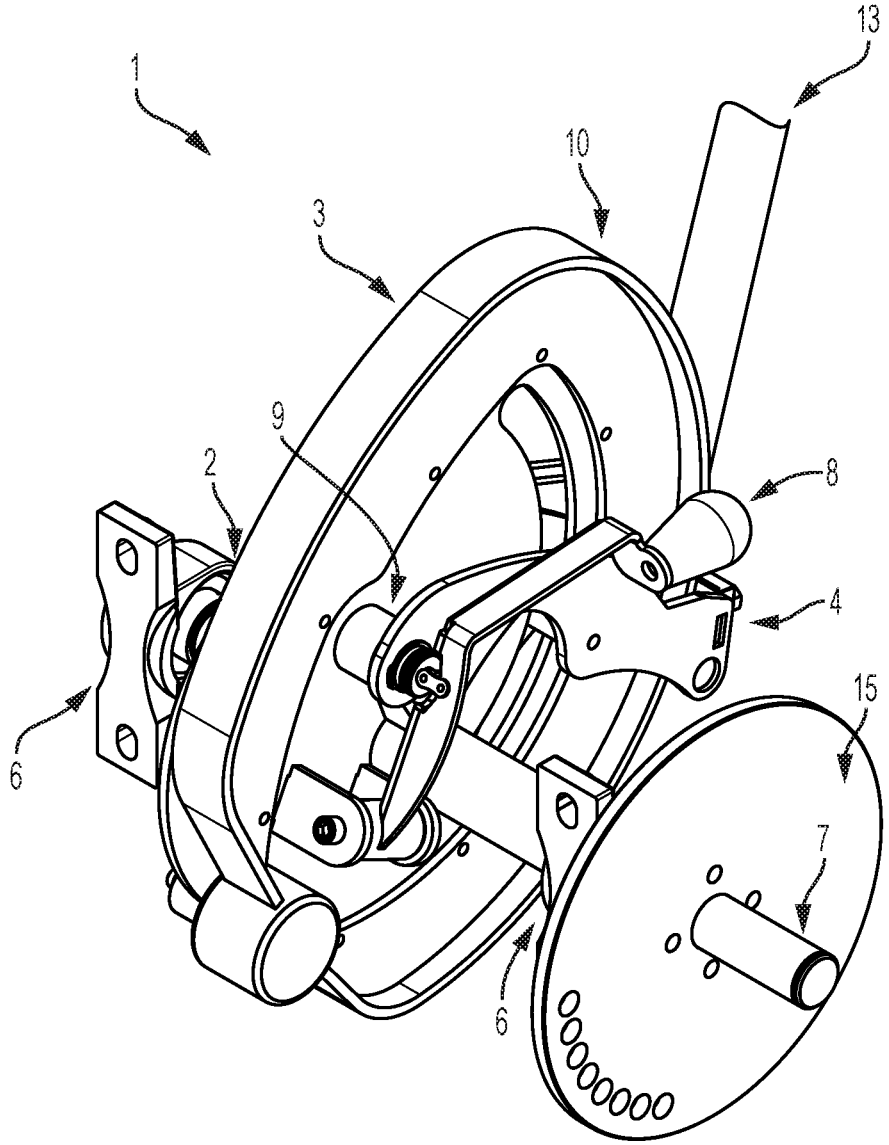
FIG. 2 is a front perspective view of the cam mechanism of FIG. 1.
Figure 3:
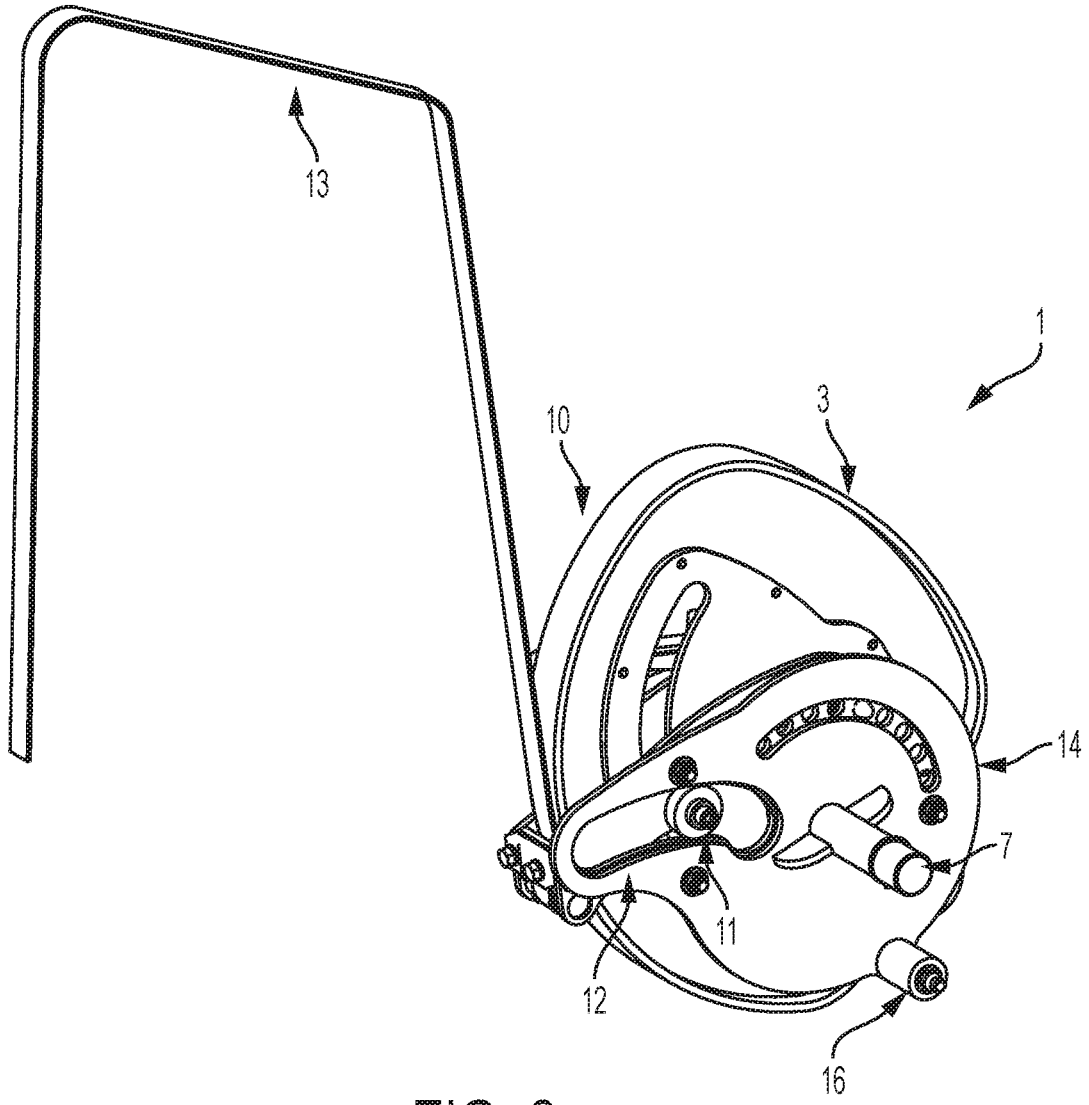
FIG. 3 is a rear perspective view of the cam mechanism of FIG. 1.
Figure 4:
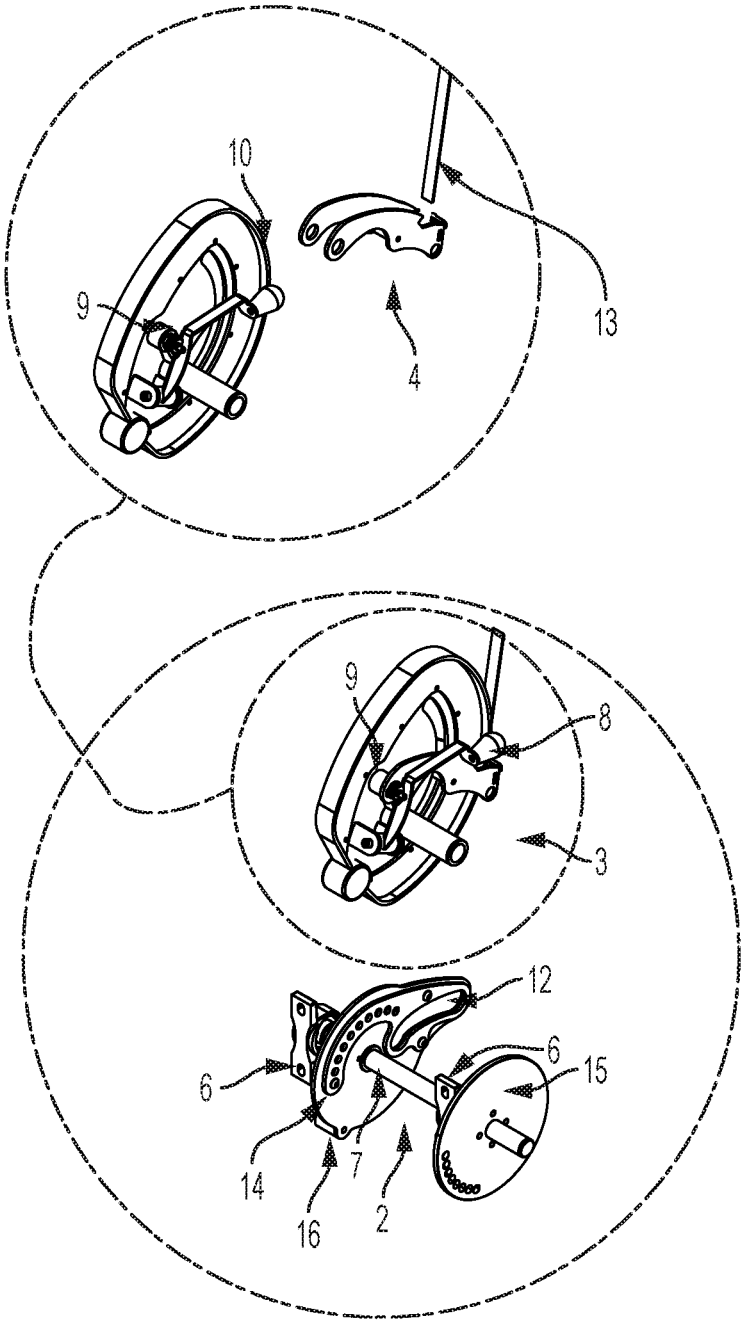
FIG. 4 is an exploded view of the cam mechanism of FIG. 1.

For purposes of the description hereinafter, the terms "upper", "lower", "right", "left", "vertical", "horizontal", "top", "bottom", "lateral", "longitudinal", and derivatives thereof, shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

According to a preferred and non-limiting embodiment, an adjustable cam is used to vary the weight load based on adjustments made by the user. The user is able to adjust the resistance and strength curve of an exercise machine by disengaging an adjustment handle and rotating a cam about an axis with respect to the exercise machine.

Referring now to FIGS. 1-4, an exercise machine 100 may include one or more cam mechanisms 1. Generally, the exercise machine 100 includes a moveable weight stack selectably connected to one end of a belt or cable 13, which is routed through a series of pulleys. The other end of the belt or cable 13 is attached to the cam mechanism 1. The exercise machine 100 further includes an exercise input arm 5 that rotates the cam mechanism 1 when a user exerts sufficient force against the exercise input arm 5. Rotation of the cam mechanism 1 pulls the belt or cable 13 around the series of pulleys and raises the moveable weight stack.

The cam mechanism 1 includes a main shaft assembly 2 rotatably mounted to one or more bearings 6 that are affixed to a support frame of the exercise machine 100. The main shaft assembly 2 further includes an axis shaft 7 which defines an axis of rotation of a cam assembly 3 and the exercise input arm 5. The cam assembly 3 includes a profile arc 10 along which the belt or cable 13 rides, thus transmitting the motion of the user through the belt or cable 13 to the moveable weight stack. The cam mechanism 1 includes a stop 16 that engages a surface of the exercise machine 100 when the range of motion of the exercise input arm 5 is reached.

The exercise input arm 5 is attached to the axis shaft 7 either directly or via an input range plate 15. The input range plate 15 is rigidly attached to the axis shaft 7, for example by a weld or keyed hub. The input range plate 15 facilitates rotational adjustment between the cam mechanism 1 and the exercise input arm 5. For example, the input range plate 15 may include a popper pin insertable into a plurality of adjustment holes, each of which corresponds to a different resting position of the exercise input arm 5. Engagement of the popper pin with one of the adjustment holes locks rotation of the exercise input arm 5 relative to the cam mechanism 1.

The cam assembly 3 is rotatable relative to the axis shaft 7, and includes an adjustment handle 8 adapted to lock and release the cam assembly 3 to a cam range slot plate 14 that is rigidly connected to the axis shaft 7. The cam range slot plate 14 may be connected to the axis shaft 7, for example, by a weld or keyed hub. The cam range slot plate 14 includes a plurality of adjustment holes, each corresponding to a different position of the cam assembly 3 relative to the cam range slot plate 14. The adjustment handle 8 includes a pin engageable with the plurality of adjustment holes. By engaging the adjustment handle 8 with any of the plurality of adjustment holes of the cam range slot plate 14, the cam assembly 3 is rotationally locked to the cam range slot plate 14, the axis shaft 7, and the input range plate 15. In this locked state, force exerted against the exercise input arm 5 is transmitted to the cam assembly 3 and through the belt or cable 13.

When the adjustment handle 8 is disengaged from the plurality of adjustment holes of the cam range slot plate 14, the cam assembly 3 may be rotated relative to the cam range slot plate 14, the axis shaft 7, and the input range plate 15. Therefore, the user can adjust the torque required to rotate the cam assembly 3 with the exercise input arm 5 by disengaging the adjustment handle 8, rotating the cam assembly 3 to the desired position, and re-engaging the adjustment handle 8 with the desired adjustment hole to lock the cam assembly 3 to the input range plate 15, all while the exercise input arm 5 remains at rest.

The cam assembly 3 further includes a belt adjustment lever 4 pivotally mounted to the body of the cam assembly 3 at a pivot axis 9 located at the radial center of the profile arc 10. The belt adjustment lever 4 includes a pivot axis that is substantially parallel with a pivot axis of the cam assembly 3. In the embodiment shown in FIGS. 1-7, the pivot axis 9 between the belt adjustment lever 4 and the cam assembly 3 is also coaxial with the pin of the adjustment handle 8. The belt adjustment lever 4 is connected to the end of the belt or cable 13 opposite the moveable weight stack. The belt adjustment lever 4 includes a control bearing 11 slideable in a corresponding slot 12 in the cam range slot plate 14. During adjustment of the cam assembly 3 relative to the cam range slot plate 14, the belt adjustment lever 4 pivots about the pivot axis 9 and the control bearing 11 is guided along a top surface of the slot 12. Thus, the position of the belt adjustment lever 4 and, therefore, the attachment point of the belt or cable 13 on the belt adjustment lever, may be changed by adjustment of the cam assembly 3. The slot 12 is eccentrically shaped such that as the cam assembly 3 is rotated and the control bearing 11 slides along the slot 12, the belt or cable 13 attachment point of the belt adjustment lever 4 maintains the same overall distance from the moveable weight stack. As a result, no slack is able to develop in the belt or cable 13 throughout the range of adjustability of the cam assembly 3. Additionally, since the slot 12 fully constrains the control bearing 11, there is no risk of the belt or cable 13 separating from the cam assembly 3 even if the belt or cable 13 were to loosen.

Figure 5:
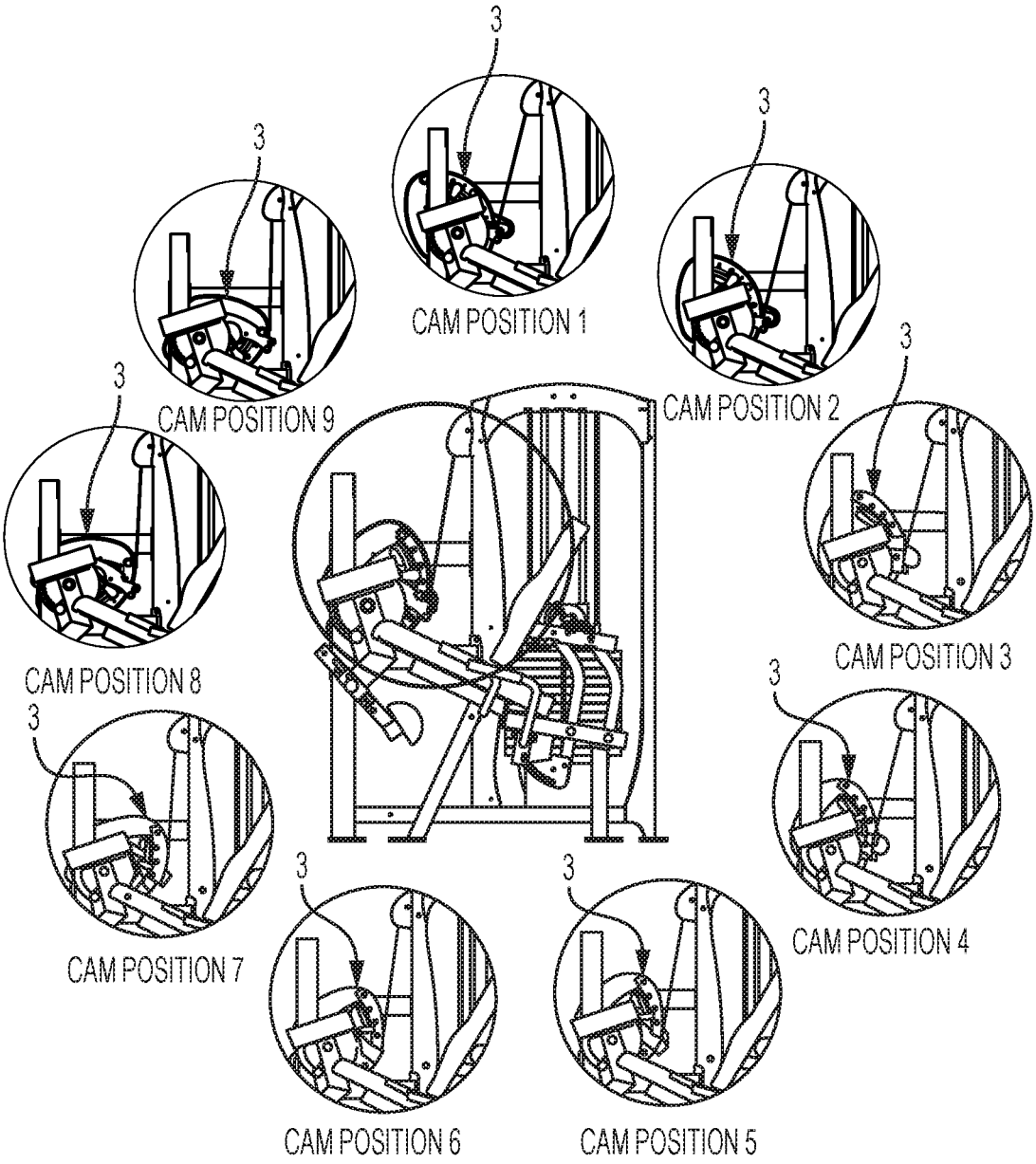
FIG. 5 is a front view of the exercise machine of FIG. 1 showing the cam mechanism in several different operating positions.
Figure 6:
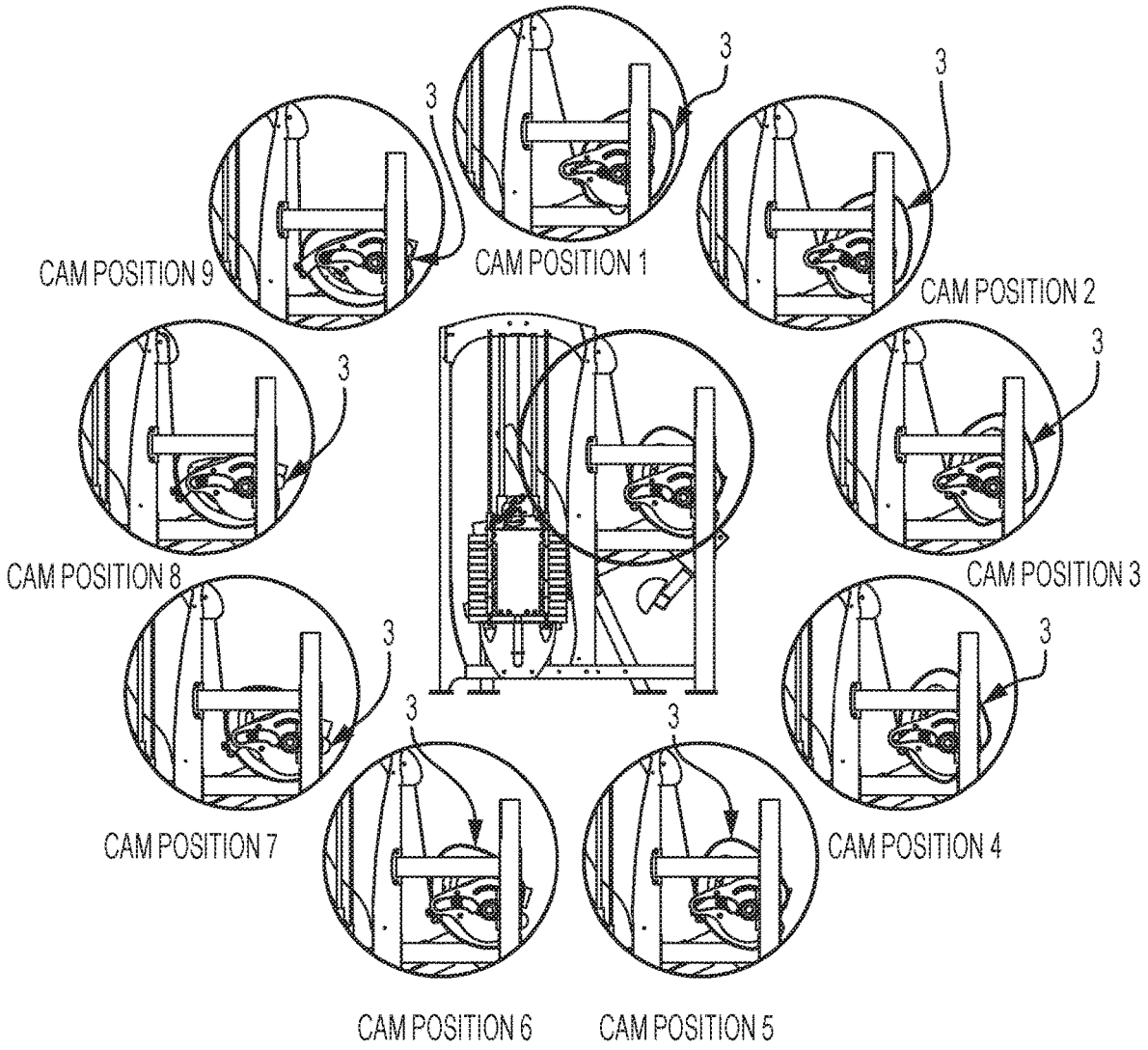
FIG. 6 is a rear view of the exercise machine of FIG. 1 showing the cam mechanism in several different operating positions.
Figure 7:
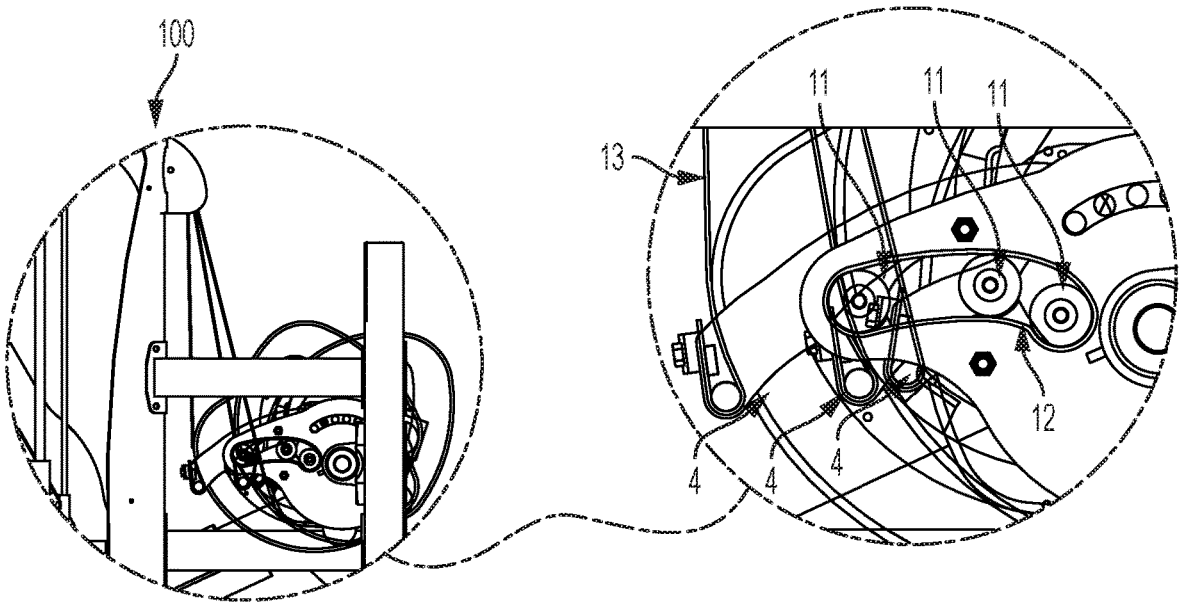
FIG. 7 is a rear view of the exercise machine of FIG. 1 showing the cam mechanism in several different operating positions.

Referring now to FIGS. 5-7, the cam assembly 3 is shown in several different positions corresponding to each of the plurality of adjustment holes of the cam range slot plate 14. In each position, the cam range slot plate 14, input range plate 15, and exercise input arm 5 remain in the resting position while the cam assembly 3 is rotated about the axis shaft 7. As the cam assembly 3 is rotated, the belt adjustment lever 4 rotates about the pivot axis 9 and is guided into a predetermined position by the interaction between the control bearing 11 and the slot 12 of the cam range slot plate 14. In each position of the cam assembly 3 and belt adjustment lever 4, the total distance between the belt or cable 13 attachment points on the weight stack and on the belt adjustment lever 4 remains constant so that no slack is able to develop in the belt or cable 13. Further, in each position of the cam assembly 3 and belt adjustment lever 4, the belt or cable 13 runs tangential to the profile arc 10. This ensures that the initial torque required at the start of an exercise motion is not abnormally high relative to the rest of the exercise motion.

Figure 8:
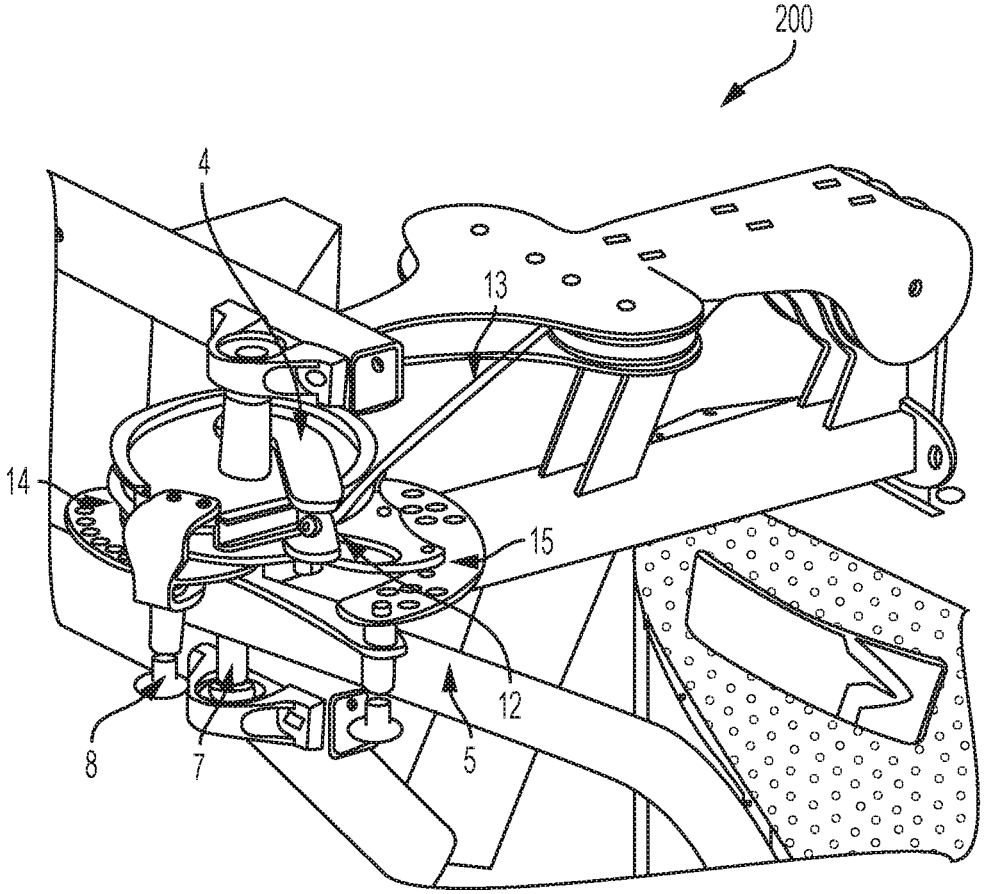
FIG. 8 is a perspective view of another embodiment of an exercise machine including a cam mechanism of the present invention.
Figure 9:
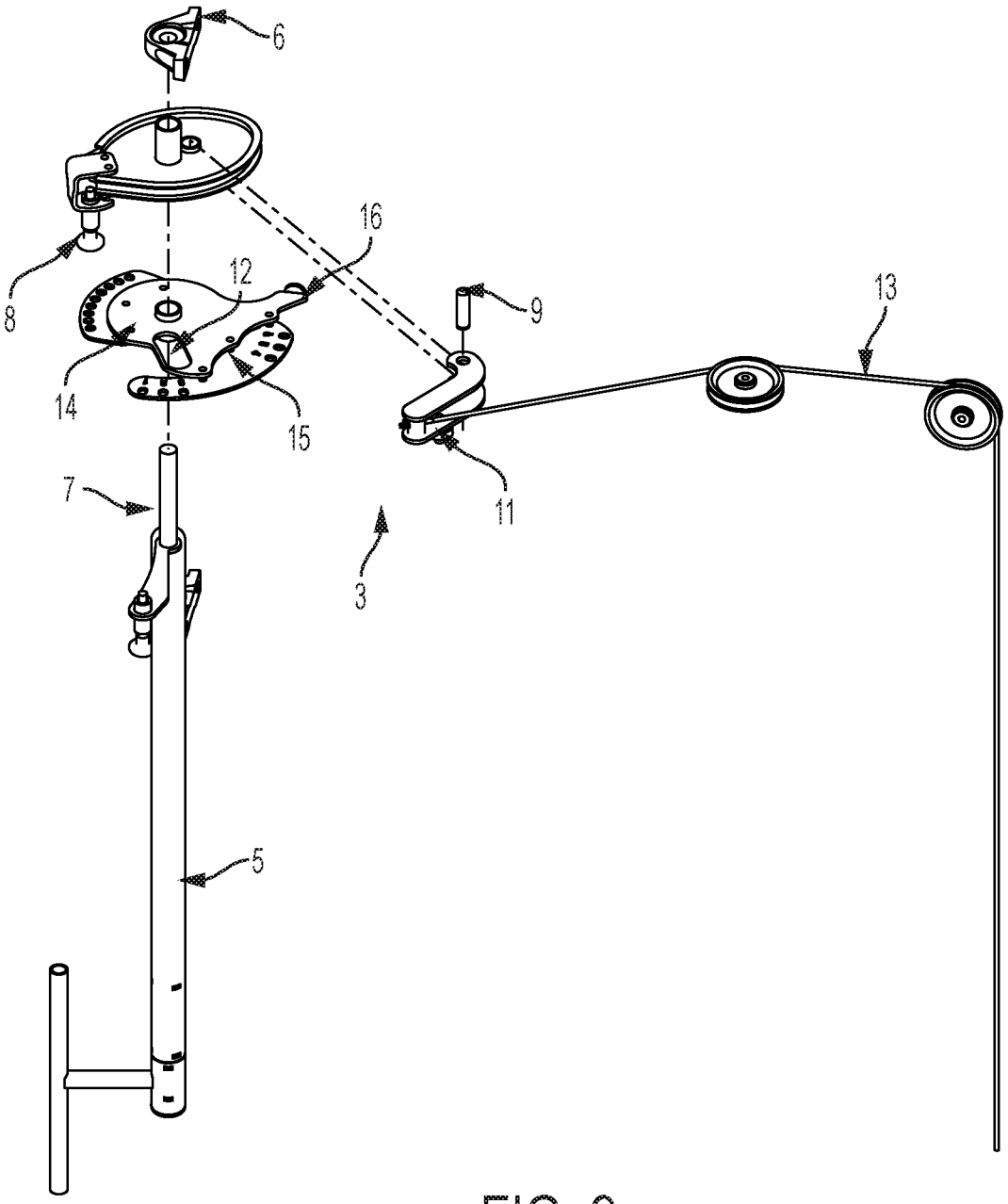
FIG. 9 is an exploded view of the cam mechanism of FIG. 8.
Figure 10:
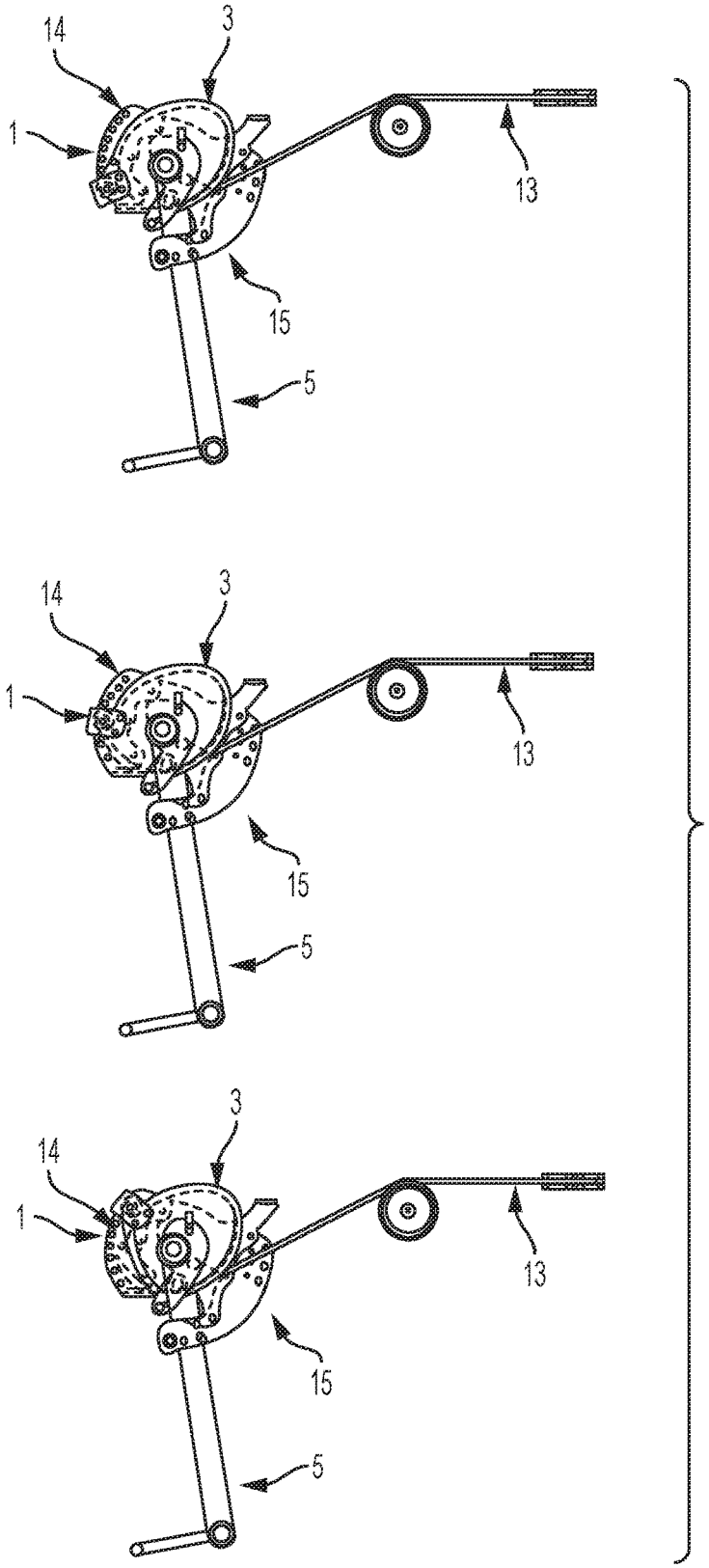
FIG. 10 is a top view of the exercise machine of FIG. 8 showing the cam mechanism in several different operating positions.

Referring now to FIGS. 8-10, an alternate embodiment of an exercise machine 200 is shown in which the cam mechanism 1 is oriented overhead of the user and on its side so that rotation of the exercise input arm 5 occurs on a horizontal plane rather than a vertical plane. The exercise machine 200 may include a second cam assembly (not shown) such that the exercise machine 200 can be used for exercises requiring input from both of the user's arms. Generally, the cam mechanism 1 shown in FIGS. 8-10 operates in the same manner as the cam mechanism 1 shown in FIGS. 1-7. In the drawings, like reference numerals refer to the same or functionally similar parts between the embodiments of FIGS. 1-7 and FIGS. 8-10.

Certain minor modifications may be made to the cam mechanism 1 to facilitate easier operation in the overhead configuration. For example, the adjustment handle 8 may be a popper pin oriented downward so that the user can pull the adjustment handle 8 straight down. In this configuration, the pivot axis 9 is not coaxial with the pin of the adjustment handle 8.

Referring now to FIG. 10, the cam assembly 3 of the exercise machine 200 is shown in a few of the possible resting positions corresponding to some of the plurality of adjustment holes of the cam range slot plate 14. As with the cam assembly shown in FIGS. 1-7, the cam assembly 3 is rotated about the axis shaft 7, causing the belt adjustment lever 4 to rotate about the pivot axis 9 and the control bearing 11 to slide into a predetermined position in the slot 12 of the cam range slot plate. In each position of the cam assembly 3 and belt adjustment lever 4, the total distance between the belt or cable 13 attachment points on the weight stack and on the belt adjustment lever 4 remains constant so that no slack is able to develop in the belt or cable 13.

Several variations of the cam mechanism 1 would be recognized by one skilled in the art. For example, the size of the cam assembly 3 could be changed to suit the specific exercise motion that the exercise machine 100, 200 is intended to facilitate.

While various aspects of the system and the user interface and methods of operating the user interface were provided in the foregoing description, those skilled in the art may make modifications and alterations to these aspects without departing from the scope and spirit of the disclosure. For example, it is to be understood that this disclosure contemplates that, to the extent possible, one or more features of any aspect may be combined with one or more features of any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A cam mechanism comprising:

a cam assembly rotatably mounted to an axis shaft and having a profile arc adapted for receiving a belt or cable;

a belt adjustment lever pivotally mounted to the cam assembly and having a control bearing; and a cam range slot plate rigidly mounted to the axis shaft and defining a slot in sliding communication with the control bearing of the belt adjustment lever;

wherein the belt adjustment lever is connected to one end of the belt or cable, and the opposite end of the belt or cable is connected to a moveable weight stack; and wherein the cam assembly is rotatable relative to the cam range slot plate.

2. The cam mechanism as claimed in claim 1, further comprising an input range plate positioned on the axis shaft.

3. The cam mechanism as claimed in claim 2, wherein the input range plate facilities rotational movement between the cam mechanism and an exercise arm attached to the cam mechanism.

4. The cam mechanism as claimed in claim 1, wherein the cam assembly is lockable in a plurality of predetermined positions relative to the cam range slot plate.

5. The cam mechanism as claimed in claim 1, wherein rotation of the cam assembly relative to the cam range slot plate causes the control bearing of the belt adjustment lever to slide within the slot of the cam range slot plate.

6. The cam mechanism as claimed in claim 1, wherein a pivot axis of the belt adjustment lever is parallel to a pivot axis of the cam assembly.

7. The cam mechanism as claimed in claim 1, wherein the slot defined in the cam range slot plate is eccentric.

8. The cam mechanism as claimed in claim 1, wherein, as the cam assembly is rotated and the control bearing slides along the slot, a belt attachment point of the belt adjustment lever maintains a same overall distance from the movable weight stack.

9. The cam mechanism as claimed in claim 1, wherein the slot fully-constrains the control bearing therein.

10. An exercise machine, comprising:

a movable weight stack;

an exercise arm connected to the movable weight stack via a belt or cable, wherein the exercise arm is rotatable about an axis shaft; and a cam mechanism positioned on the axis shaft, the cam mechanism comprising:

a cam assembly rotatably mounted to the axis shaft and having a profile arc adapted for receiving the belt or cable;

a belt adjustment lever pivotally mounted to the cam assembly and having a control bearing; and a cam range slot plate rigidly mounted to the axis shaft and defining a slot in sliding communication with the control bearing of the belt adjustment lever;

wherein the belt adjustment lever is connected to one end of the belt or cable, and the opposite end of the belt or cable is connected to the moveable weight stack; and wherein the cam assembly is rotatable relative to the cam range slot plate.

11. The exercise machine as claimed in claim 10, further comprising an input range plate positioned on the axis shaft.

12. The exercise machine as claimed in claim 11, wherein the input range plate facilities rotational movement between the cam mechanism and the exercise arm attached to the cam mechanism.

13. The exercise machine as claimed in claim 10, wherein the cam assembly is lockable in a plurality of predetermined positions relative to the cam range slot plate.

14. The exercise machine as claimed in claim 10, wherein rotation of the cam assembly relative to the cam range slot plate causes the control bearing of the belt adjustment lever to slide within the slot of the cam range slot plate.

15. The exercise machine as claimed in claim 10, wherein a pivot axis of the belt adjustment lever is parallel to a pivot axis of the cam assembly.

16. The exercise machine as claimed in claim 10, wherein the slot defined in the cam range slot plate is eccentric.

17. The exercise machine as claimed in claim 10, wherein, as the cam assembly is rotated and the control bearing slides along the slot, a belt attachment point of the belt adjustment lever maintains a same overall distance from the movable weight stack.

18. The exercise machine as claimed in claim 10, wherein the slot fully-constrains the control bearing therein.

19. A method of adjusting a cam mechanism on an exercise machine, comprising:

rotating a cam assembly relative to a cam range slot plate;

moving a control bearing of a belt adjustment lever within a slot defined in the cam range slot plate to maintain a distance between a belt attachment point of the belt adjustment lever relative to a movable weight stack; and locking the cam assembly to prevent rotation of the cam assembly relative to the cam range slot plate.

20. The method as claimed in claim 19, wherein the slot is eccentric.

* * * * *